US006547554B2

(12) United States Patent
Koegl et al.

(10) Patent No.: US 6,547,554 B2
(45) Date of Patent: Apr. 15, 2003

(54) COMBUSTION SYSTEM, A METHOD OF ADAPTING THE PERFORMANCE OF THE COMBUSTION SYSTEM AND A COOKING DEVICE UTILIZING THE COMBUSTION SYSTEM

(75) Inventors: Rudolf Koegl, deceased, late of Thaining (DE), by Elfriede Kögl, Stephanie Kögl, legal representatives,; by Sabine Kögl, legal representative, Raisting (DE); Manfred Lichtenstern, Weil/Petzenhausen (DE); Roland Hegmann, Langerringen (DE); Simon Pattermann, Gilching (DE); Franz Koch, Untermeitingen (DE); Jaroslav Klouda, Fuerstenfeldbruck (DE); Rainer Otminghaus, Landsberg/Lech (DE)

(73) Assignee: Rational Aktiengesellschaft, Landsberg/Lech (DE)

( * ) Notice: Subject to any disclaimer, the term of this patent is extended or adjusted under 35 U.S.C. 154(b) by 0 days.

(21) Appl. No.: 09/898,945

(22) Filed: Jul. 5, 2001

(65) Prior Publication Data

US 2002/0115030 A1 Aug. 22, 2002

(30) Foreign Application Priority Data

Jul. 5, 2000 (DE) ..... 100 32 764

(51) Int. Cl.[7] ..... F23N 1/00

(52) U.S. Cl. ..... 431/12; 431/76; 431/89; 431/354; 126/39 R; 126/19 R

(58) Field of Search ..... 431/12, 350, 354, 431/353, 76, 89, 10; 126/39 R, 39 E, 19 R; 48/189.1, 190, 184, 191; 137/3, 2, 114, 98; 432/103

(56) References Cited

U.S. PATENT DOCUMENTS

| | | | | | |
|---|---|---|---|---|---|
| 2,719,080 | A | * | 9/1955 | Schmidt et al. | 48/184 |
| 3,119,672 | A | * | 1/1964 | Peirce | 48/189.1 |
| 4,277,254 | A | * | 7/1981 | Hanson | 48/189.1 |
| 5,190,454 | A | * | 3/1993 | Murray et al. | 431/354 |

FOREIGN PATENT DOCUMENTS

| | | |
|---|---|---|
| DE | 39 37 290 | 5/1990 |
| DE | 41 18 781 | 12/1992 |
| DE | 198 38 361 | 3/1999 |
| GB | 2 226 163 | 6/1999 |

* cited by examiner

*Primary Examiner*—James C. Yeung
(74) *Attorney, Agent, or Firm*—Schiff Hardin & Waite

(57) ABSTRACT

A combustion system and a method for adapting the combustion system to utilize a first fuel when the system has been designed for a second fuel. The method and system provide inlets for adding air to lower the quality of the first fuel to the quality of the second fuel or inlets for adding a third fuel of a higher quality than the second fuel to raise the quality of the first fuel to the level of the quality of the second fuel.

8 Claims, 1 Drawing Sheet

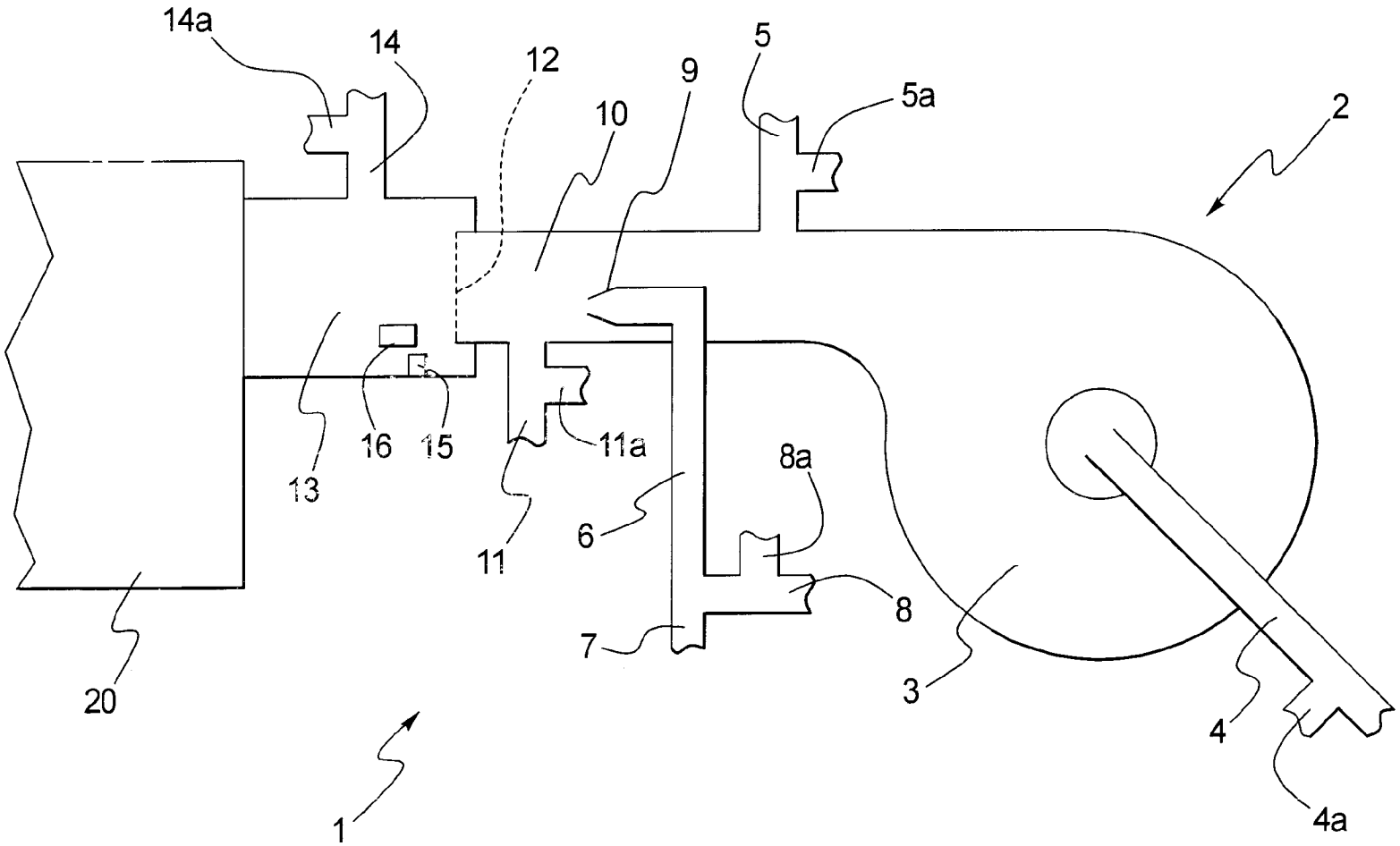
2
4a
4
3
5a
8
8a
5
9
6
7
10
11a
12
11
15
14
16
1
13
14a
20

COMBUSTION SYSTEM, A METHOD OF ADAPTING THE PERFORMANCE OF THE COMBUSTION SYSTEM AND A COOKING DEVICE UTILIZING THE COMBUSTION SYSTEM

BACKGROUND OF THE INVENTION

The present invention is directed to a method for adapting the performance of a combustion system having at least one burner by controlling and/or regulating the fuel/air mixture of the supplied fuel in the burner corresponding to the quality and/or the caloric content of a standard fuel. The invention is also directed to a combustion system having the burner, a fan and at least one air feeder and at least one fuel feeder, a burner discharge, a burner shaft leading from the fan to the burner discharge, a nozzle situated in the burner shaft for injecting at least one fuel or fuel/air mixture and an ignitor downstream of the nozzle, which system is used with a cooking device having a cooking chamber heated by the combustion system.

Gases having different compositions within a three-gas family, which is composed of city gas, natural gas and liquefied gas, and these are distributed in the domestic and industrial gas supplies. City gas is that gas which has been manufactured, such as by a gasification process of coal, and is sometimes referred to as "coal gas". As a result, the performance of a combustion system fluctuates corresponding to the quality of the respectively used gas, which is essentially determined by the caloric content of the gas. Therefore, the performance normally is adapted by manually post-adjusting the gas flow, by exchanging the nozzle or measuring the ionization current with a back-coupling with respect to a gas/air compound system. The latter, hitherto, functions only in a restricted fashion within the family of natural gases.

For example, German 198 24 521 discloses a regulating method for gas burners for providing a gas/air mixture, namely for supplying gas current and combustion air current to a burner, wherein an ionization signal of a sensor is used in order to adapt the gas/air mixture to different gas qualities.

SUMMARY OF THE INVENTION

An object of the present invention is to further develop a method so that the disadvantages of the prior art can be overcome and to particularly enable an automatic performance adaptation given combustion systems that are operated with fluid.

This object is inventively achieved by designing the combustion system for a specific quality and/or a specific caloric content of a second fuel, acquiring the quality and/or the caloric content of the first fuel and supplying air and/or at least a third fuel, dependent on the determined quality and dependent on the caloric content of the first fuel, to bring the first fuel up to a point at which the specific quality and/or specific caloric content of the fuel reaches that of the second fuel.

It can be provided that the quality and/or caloric content of the first fuel is acquired by measuring at least a chemical property, an optical property and/or a physical property of the first fuel and/or of an exhaust composition of the burner.

It is inventively provided that the heat enthalpy is determined particularly from temperature differences being measured when a test body is heated by a pilot flame.

A first preferred embodiment of the invention can be characterized by a fuel being selected as a second fuel that is of less quality and/or has a lower caloric content than the first fuel. When using the first fuel, the combustion air system is preferably controlled and regulated given the first fuel being of a higher quality to bring the first fuel into comparison with the second fuel, such as by dilution.

A second embodiment of the invention is characterized in that the fuel, which is selected as a second fuel, has a higher quality and a higher caloric content than the first fuel, and in that a third fuel is of an even higher quality and/or higher caloric content compared to the second fuel and is supplied to with the first fuel so as to raise the quality and/or caloric content of the first fuel up to the level of the second fuel.

In addition, the invention also provides a combustion system having a burner, a fan, at least one air feeder, at least one fuel feeder, a burner discharge, a burner shaft leading from the fan to the burner discharge, a nozzle situated in the burner shaft for injecting at least one first fuel and/or a fuel/air mixture and an ignitor downstream of the nozzle. The inventive method is used for adapting the performance of the combustion system and, dependent on the quality and/or the caloric content of the second fuel selected for designing the combustion system, the air can be supplied upstream of the fan, downstream of the fan, upstream of the nozzle, downstream of the nozzle and/or downstream of the burner discharge or at least a third fuel can be supplied upstream of the fan, downstream of the fan, upstream of the nozzle, downstream of the nozzle and/or upstream of the burner discharge.

At least one chamber is provided leading to the fan, to the burner shaft, upstream or downstream of the nozzle, to the nozzle and to the burner discharge and which preferably is fashioned as an external premix chamber for premixing the first fuel and/or the third fuel with air.

The invention also suggests further developments being characterized by a device for determining the quality and/or caloric content of the first fuel, whereby the device for determining the quality and/or the caloric content of the first fuel preferably has a test body, which can be heated by a pilot flame within or outside of the burner, a smell sensor, a viscosity sensor and/or an exhaust sensor.

Finally, the invention relates to a cooking device having a cooking chamber which can be heated via the inventive combustion system.

Therefore, the invention is based on the surprising knowledge that the combustion system can be designed for a specific fuel, for example for the lowest-caloric gas of the three-gas family, namely the city gas or manufactured gas. Given the feeding of a fuel of a higher order, such as natural gas or liquified gas, the air is supplied to the combustion system at different locations up to a point at which the heat content of the fuel/gas mixture corresponds again to the basic design of the combustion system. It can also be inventively provided that the combustion system is designed for a high-caloric fuel, such as a natural gas, and that a high-caloric fuel, such as liquified gas or natural gas, is added when a lower-caloric fuel, such as manufactured or city gas, is used. For the first time, the performance, thus, can be automatically adapted given combustion systems that are operated by gas, in particular.

The fuel quality, particularly the gas quality, is to be automatically recognized, for example by measuring the heat enthalpy by means of a pilot flame, which is fashioned separately or as a component of the burner and which heats up a test body, so that the temperature differences occurring as a result of the heating can be evaluated in order to determine the heat enthalpy. Furthermore, the gas can be recognized via a smell sensor, a viscosity sensor os such. The quality of the gas basically can also be determined by measuring the composition of the exhaust.

Other advantages and features of the invention will be readily apparent from the following description of the preferred embodiments, the drawing and claims.

BRIEF DESCRIPTION OF THE DRAWINGS

The FIGURE is a diagrammatic cross-section of a combustion system of the present invention.

DESCRIPTION OF THE PREFERRED EMBODIMENTS

As illustrated in the FIGURE, the inventive combustion system, generally indicated at 1, has a burner, generally indicated at 2. The burner 2 has a fan 3 with an air feeder 4, which fan discharges into a burner shaft 10 that has a burner discharge into a tube or pipe 13 extending to a heat exchanger for a cooking device 20. A second air feeder 5 is arranged downstream of the fan 3 and a combination fuel/air feeder 6 with a fuel feeder 7 and a third air feeder 8 terminates downstream of the second air feeder 5 in a nozzle 9 positioned in the burner shaft 10. A fourth air feeder 11 is positioned between the nozzle 9 and the burner discharge 12 of the burner shaft 10. A fifth air feeder 14 is positioned downstream of the burner discharge 12 in the tube or pipe 13, which extends to the heat exchanger. An ignition device 15 is arranged in the area of the tube 13. The ignition device 15 may be a pilot flame which heats up a test body 16 for determining the heat enthalpy of the gas.

The combustion system described with respect to its structure operates as follows.

Given the design of the combustion system 1 for the lowest caloric fuel of the delivery system, such as city gas or manufactured gas, air additionally can be fed in a regulated fashion via the fuel feeder 7, namely via at least one of the air feeders 4, 5, 8, 11 and/or 14, in accordance with the arrangement set forth in the table. With the addition of the air to the natural gas/air mixture, this mixture will soon approach a heat content, as in the case of the utilization of the manufactured gas or city gas, even given feeding of a higher-caloric fuel, such as natural gas.

TABLE

| | first air feeder 4 | second air feeder 5 | gas feeder 7 | third air feeder 8 | fourth air feeder 11 | fifth air feeder 14 |
|---|---|---|---|---|---|---|
| natural gas | | | X | | | |
| air | X | | | | | |
| natural gas | | | X | | | |
| air | | X | | | | |
| natural gas | | | X | | | |
| air | | | | X | | |
| natural gas | | | X | | | |
| air | | | | | X | |
| natural gas | | | X | | | |
| air | | | | | | X |

The combustion system 1 can also be operated with a first fuel of a low-caloric content gas, but the burner is designed for a high-caloric gas or second fuel. Analogous to the design of a burner for the lowest-caloric gas, a third fuel of a higher caloric content, such as a liquefied gas, can be added by at least one gas feeder, such as fuel feeder 4*a*, 5*a*, 8*a*, 11*a* and/or 14*a*, which can be arranged in the area of the air feeders 4, 5, 8, 11 and/or 14. This will bring the heat content of the first fuel up to the previous design qualifications of the second fuel.

Although various minor modifications may be suggested by those versed in the art, it should be understood that we wish to embody within the scope of the patent granted hereon all such modifications as reasonably and properly come within the scope of our contribution to the art.

We claim:

1. A method for adapting a performance of a combustion system for a cooking device, said method comprising the steps of:

providing a cooking device having a cooking chamber with a heat exchanger in communication with a burner having an air inlet and being connected to a supply of a first fuel, said burner being designed for a specific quality and caloric content of a second fuel;

determining the quality and the caloric content of the first fuel; and then adding a gas selected from additional air and a third fuel to the burner dependent on the determined quality and caloric content of the first fuel to create a mixture of the first fuel, air and the gas for burning in the burner, which mixture has the specific quality and caloric content of the second fuel.

2. A method according to claim 1, wherein the step of determining the quality and caloric content of the first fuel is by measuring one of a property of the first fuel and an exhaust composition of the first fuel, said property being selected from a group consisting of a chemical property, an optical property, a physical property and combinations of the chemical, optical and physical properties.

3. A method according to claim 2, wherein a heat enthalpy of the mixture is determined from a temperature difference that is measured when a test body is heated by a pilot flame of the mixture.

4. A method according to claim 1, wherein the first fuel has a higher quality and caloric content than the second fuel and said step of adding gas supplies additional air to the burner to change the quality and caloric content of the mixture to be in agreement with the second fuel.

5. A method according to claim 1, wherein the second fuel has a higher specific quality and caloric content than the first fuel and said step of adding gas adds a third fuel of a higher quality and caloric content than the second fuel to raise the quality and caloric content of the mixture up to that of the second fuel.

6. A combustion system for heating a cooking chamber of a cooking device, said system comprising a burner having a fan discharging air into a burner shaft, said burner shaft leading to a burner discharge connected to a heat exchange of the cooking chamber, said burner having a feeder for a first fuel, said burner having a nozzle situated in the burner shaft for injecting at least a mixture of the first fuel and air into the burner shaft and an igniter downstream of the nozzle in the shaft, said system being designed to operate with a second fuel having a fixed quality and caloric content, said system having additional feeders disposed upstream and downstream of the nozzle to enable an addition of an additional fluid selected from air and a third fuel of a higher caloric content and quality than the second fuel, so that the quality and caloric content of the mixture being used in the burner can be changed to the standard of the second fuel.

7. A combustion system according to claim 6, which includes at least one chamber which leads to the fan, which leads to the nozzle, which enables premixing the first fuel and the third fuel with air.

8. A combustion system according to claim 6, which includes a device for determining the quality and caloric content of the first fuel, said device being selected from a test body, which is heated by a pilot flame, a smell sensor, a viscosity sensor and an exhaust sensor.

* * * * *